United States Patent [19]

Aprea et al.

[11] Patent Number: 4,570,860

[45] Date of Patent: Feb. 18, 1986

[54] 180° NOZZLE BODY HAVING A SOLID CONE SPRAY PATTERN

[75] Inventors: George F. Aprea, Dedham; Werner P. Pohle, Lynn, both of Mass.

[73] Assignee: Wm. Steinen Mfg. Co., Parsippany, N.J.

[21] Appl. No.: 577,176

[22] Filed: Feb. 6, 1984

[51] Int. Cl.[4] ..... B05B 1/34

[52] U.S. Cl. ..... 239/478

[58] Field of Search ..... 239/461, 463, 476–478, 239/487, 548

[56] References Cited

U.S. PATENT DOCUMENTS

| | | | |
|---|---|---|---|
| 2,050,659 | 4/1936 | Knuth | 239/461 |
| 2,531,789 | 11/1950 | Rowley | 239/476 |
| 3,045,926 | 7/1962 | Steinen | 239/457 |
| 3,072,346 | 1/1963 | Wahlin et al. | 239/463 |
| 3,275,248 | 9/1966 | O'Brien et al. | 239/487 |
| 3,337,134 | 8/1967 | Bond | 239/487 |

FOREIGN PATENT DOCUMENTS

| | | | |
|---|---|---|---|
| 797 | of 1913 | United Kingdom | 239/461 |

*Primary Examiner*—Andres Kashnikow
*Assistant Examiner*—Scott Malpede
*Attorney, Agent, or Firm*—Ostrolenk, Faber, Gerb & Soffen

[57] ABSTRACT

A nozzle body that provides a substantially uniformly distributed spray over 180° at the discharge end in which the uniformly distributed spray in the form of solid cone is created by an inner nozzle and a uniformly distributed spray of a hollow cone is created by an outer nozzle and in which the spray from the inner and outer nozzles are immediately adjacent one another. The construction of the nozzle body is such that although the inner and outer nozzle each initially create their own spray pattern, the end result is a combined solid cone spray that could not be created by either the inner or outer nozzle alone. The nozzle body has a center vane for the inner nozzle to ensure an inner solid cone spray and may have a metering plate to direct some fluid to the outer nozzle so that the end result is a spray that is a solid cone with an angle substantially in excess of the cone created by the inner nozzle alone and having a coefficient discharge of approximately 0.99. An alternate novel feature for a fourth embodiment combined the function of the metering plate and center vane in a single disc shaped unit which permits a substantial reduction in the overall length of the nozzle body. The combination of an inner and outer nozzle to create an 180° full solid cone liquid will be particularly useful for applying liquid such as water for fixed sprinklers for fire supression systems, for roof cooling, etc.

24 Claims, 35 Drawing Figures

FIG. 6.
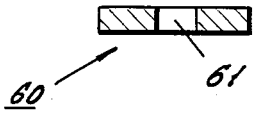
FIG. 5a.
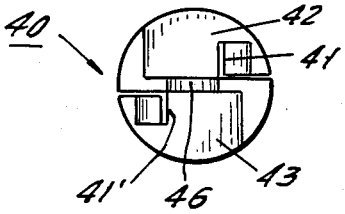
FIG. 5c.
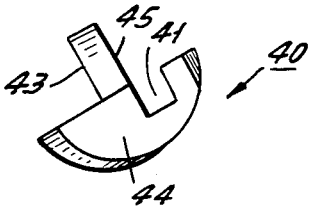
FIG. 5.
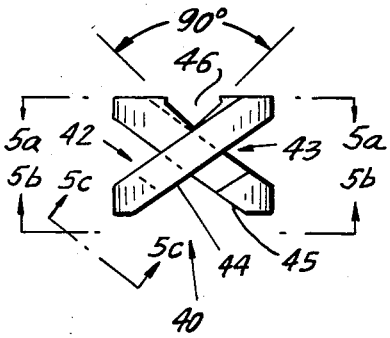
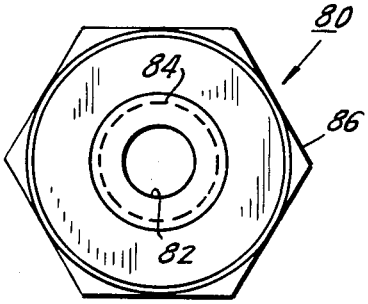
FIG. 4a.
FIG. 5b.
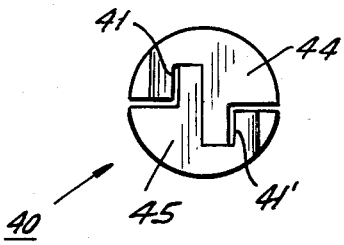
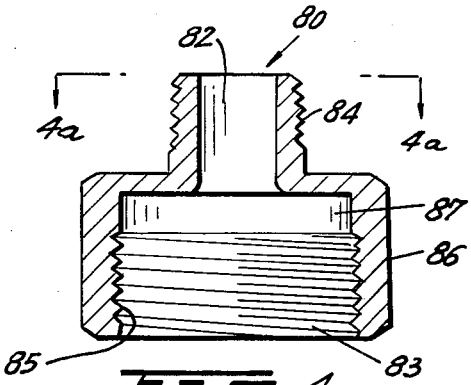
FIG. 4.

FIG. 7.
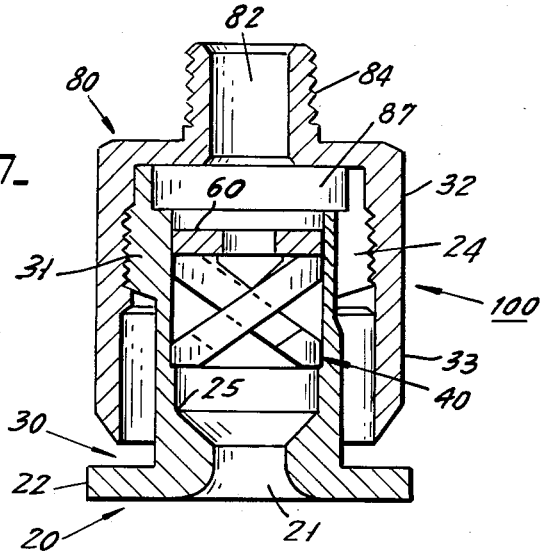
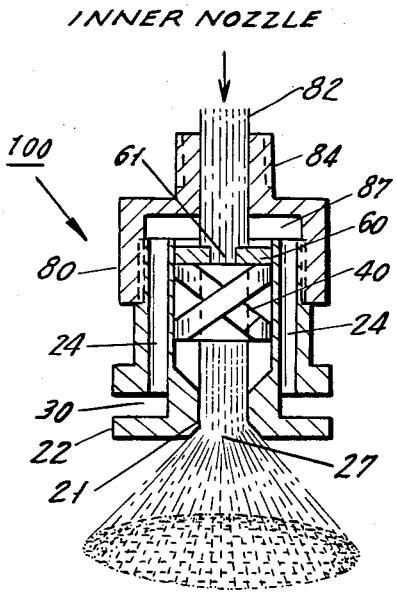
FIG. 10a
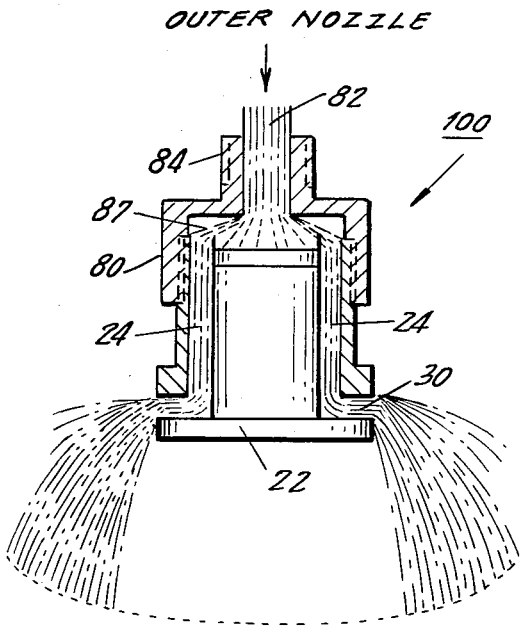
FIG. 10b.

FIG. 8b.
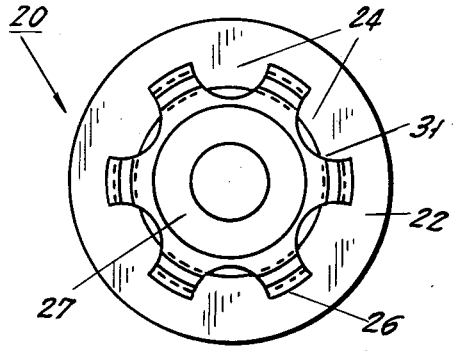
FIG. 9b.
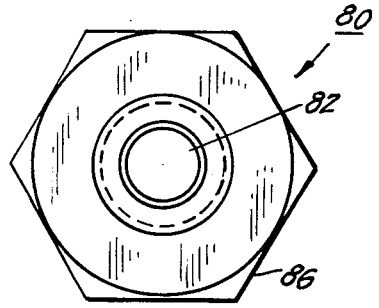
FIG. 8.
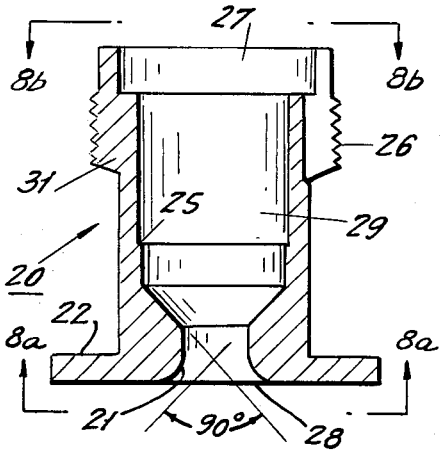
FIG. 9.
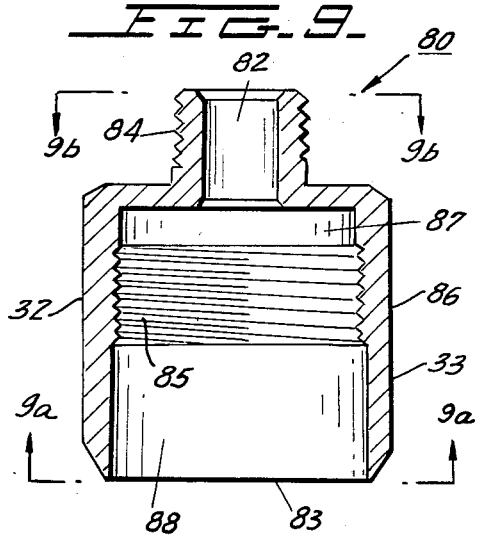
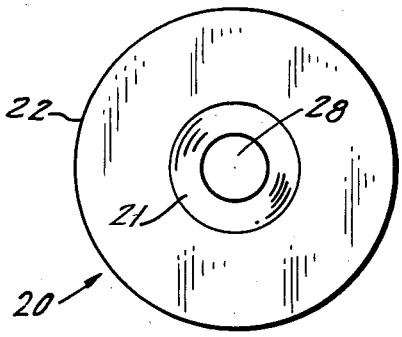
FIG. 8a.
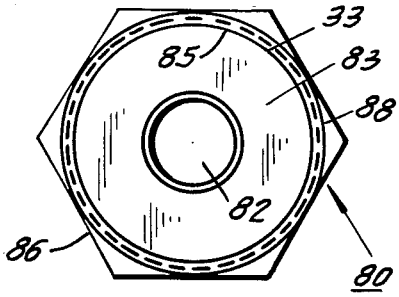
FIG. 9a.

FIG. 11.
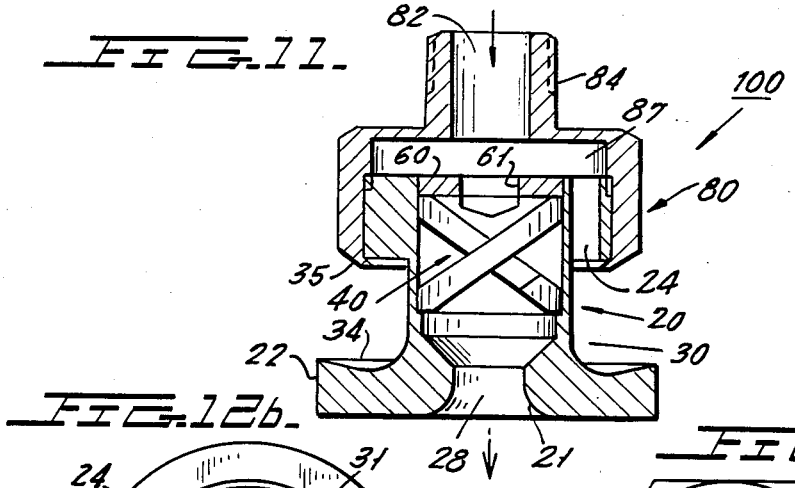
FIG. 12b.
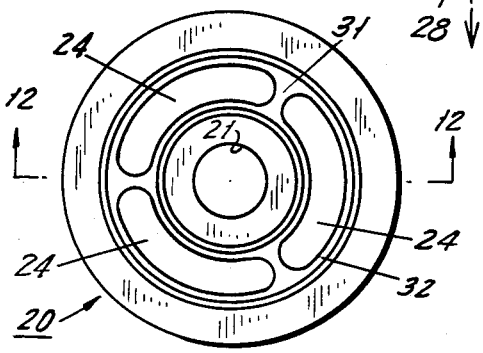
FIG. 13b.
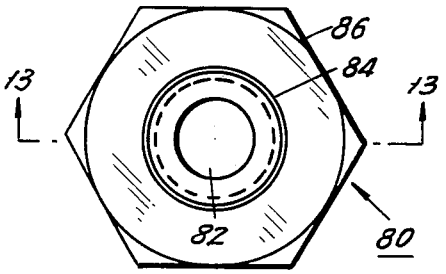
FIG. 12.
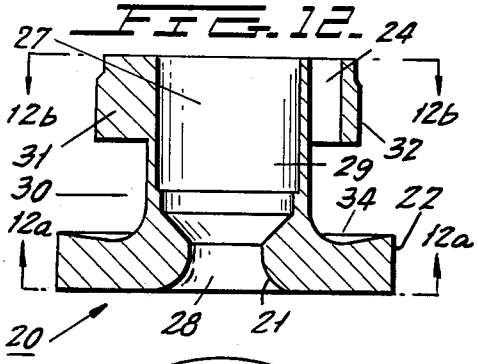
FIG. 13.
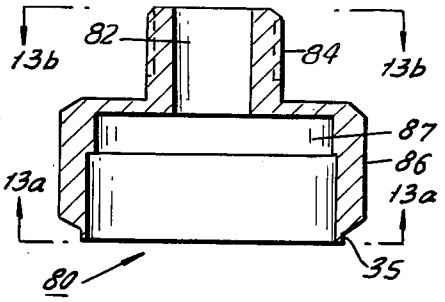
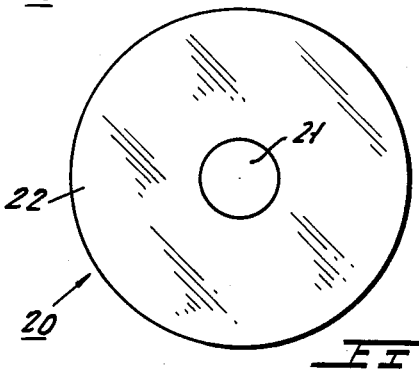
FIG. 12a.
FIG. 13a.
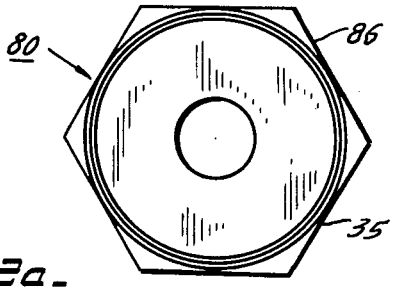

FIG. 14.
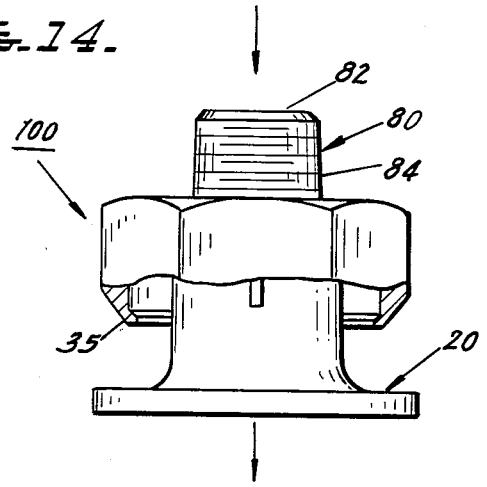
FIG. 16.
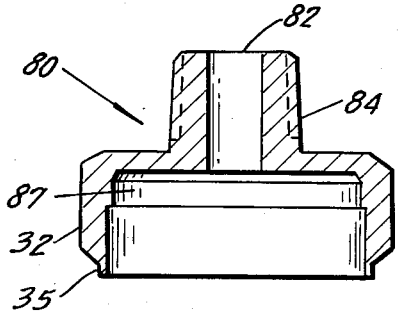
FIG. 15a.
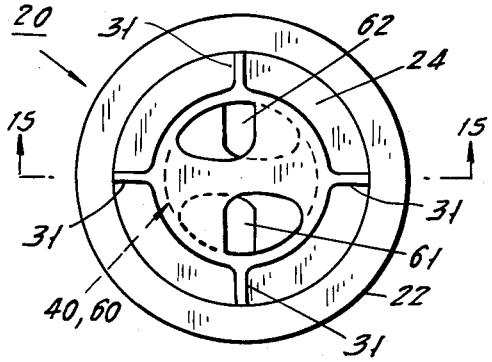
FIG. 17.
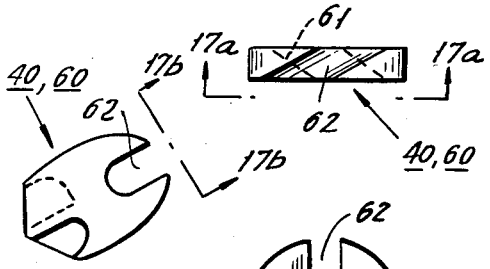
FIG. 17b.
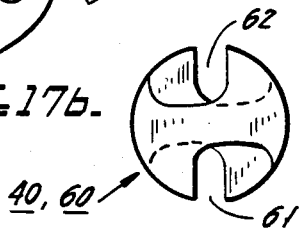
FIG. 17a.
FIG. 15.
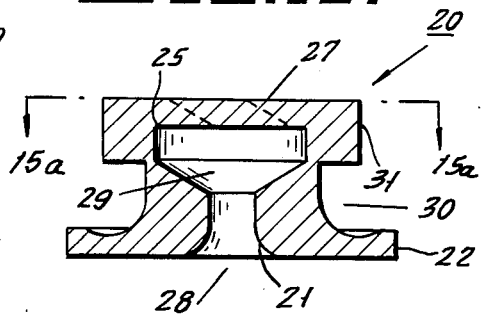

180° NOZZLE BODY HAVING A SOLID CONE SPRAY PATTERN

BACKGROUND OF THE DISCLOSURE

The present invention relates to a nozzle body that is constructed to have an inner and outer nozzle so that there is a spray pattern in the form of a solid cone of fluid and in which there can be a fluid in at least an 8 foot diameter when measured 3 inches away from the outlet end of the nozzle body. Such a nozzle body is useful for fire suppression systems, roof cooling, etc. where a large area is to be covered with fluid using a minimum number of nozzle bodies.

In the prior art it has been old and well known to have solid cone fluid spray patterns from nozzles. Such nozzles are described in U.S. Pat. Nos. 3,104,829, 3,146,674 and 3,275,248, where there is shown and described a center vane for a nozzle body that has a spray angle of 15° to 125°. Indeed the assignee of the present application, Wm. Steinen Mfg. Co., manufactures and sells a nozzle body under the trademark "SOLID-JET" that has an angle of spray patterns for a solid cone ranging up to 125°. However, it has not been possible to extend the angle much beyond 125° and hence to cover a given area it requires that more 125° nozzle bodies be used than would be required if the nozzle body had a spray angle in excess of 125° or near 180°.

In the prior art there have been nozzles that have spray angles of 160° up to 180°. Such nozzles are shown in U.S. Pat. No. 3,045,926 to W. F. Steinen entitled "SPRAY NOZZLE" and are commercially made and sold by the assignee of this case Wm. Steinen Mfg. Co. under the trademark SPAN-JET. However, these nozzles have the disadvantage that the fluid pattern is a hollow cone and hence does not have fluid in the center of the cone. Such nozzles cannot be used for fire suppression systems, roof coolers, etc. since too large an area is left without fluid.

The present invention combines the features of both the prior art solid cone nozzle and the prior art hollow cone so that there is initially a spray pattern, adjacent the nozzle body that is 180° with a diameter of at least 8 feet when measured 3 inches from the orifice.

BRIEF DESCRIPTION OF THE INVENTION

Applicant's device has an inner and outer nozzle in which the inner nozzle forms a spray pattern of a solid cone having approximately a 125° angle and an outer nozzle that forms a spray pattern of a hollow cone in which the inside angle is equal to the outside diameter of the spray pattern of the inner nozzle, i.e. 125°, and the outside angle, which is initially 180° near the orifice but is continuously reduced due to the decrease of the velocity efficiency as the fluid is sprayed away from the axis of the outer nozzle. In applicant's device the inner nozzle has a center vane to swirl the water and ensure a solid spray pattern.

A novel pressure metering plate can be located adjacent the center vane, so that some fluid can pass directly through a center opening of the metering plate to the center vane. However, the remaining fluid, which impinges directly on the metering plate is deflected to the inner wall of an inner chamber of the inner nozzle and hence more fluid can be directed to the outer nozzle. In a fourth embodiment of the invention, the function of the metering plate and center vane are combined in a single unit. The outer nozzle is comprised of a plurality of openings, which surround the inner nozzle and are all located on the same radius and are parallel to the axis of the nozzle, the axis of the nozzle being parallel to the main direction of the fluid flow through the nozzle body. These openings can vary in number i.e. sixteen (embodiment 1), six (embodiment 2), three (embodiment 3) and four (embodiment 4). The outer nozzle has a deflection plate located at the end of the nozzle body so that fluid discharged from the plurality of openings will impinge upon the deflector plate.

The deflector plate has a portion which is substantially perpendicular to the nozzle body and in particular has a ring portion onto which the fluid passing through the plurality of openings will impinge. By making this ring portion with a curve, it is possible to throw the fluid out to a greater diameter.

The nozzle body containing the inner and outer nozzles is comprised of three or four basic parts, namely a body, an adapter, a center vane and may have a separate pressure metering plate or a combined vane and meter plate. The inlet end of the adapter is used to connect to the pipe that will supply the fluid and the other end is connected to the body. Fluid from the adapter will pass through the center vane and through the inlet ends of the plurality of openings. If there is a metering plate, some fluid will impinge directly on the metering plate. The fluid which passes directly through the center opening of the metering plate will pass to the center vane, located in an inner chamber of the inner nozzle in the center of the body, and be swirled around before exiting from an orifice located at the discharge end of the body. These units and sequence comprise the inner nozzle which has a substantially solid cone spray pattern. The fluid which passes directly to the inlet end of the plurality of openings will pass through the openings and then impinge upon the deflector plate to initially throw some of the fluid out at an angle of 180°. The design of the combined nozzle is such that there is a coefficient of discharge (i.e. ratio of fluid in to fluid out) of substantially 1.00 or about 0.99.

It is noted that in embodiments 1, 2 and 3 the pressure metering plate is flush with the center vane so that a V-notch may be necessary in the center vane to permit fluid to pass from the center opening of the metering plate to the area of the V-notch and then to the center vane. The metering plate is not flush with the inlet end of the inner chamber but instead forms a small chamber, within the inner chamber, so that fluid deflected by the metering plate will impinge on the inner wall of the chamber rather than across the inlet end of the plurality of openings. This arrangement will permit fluid to be deflected for the outer nozzle and insures that efficiency of the nozzle is not decreased by having fluid at the inlet of the plurality of openings pass only parallel to the openings, and without having a perpendicular component. Since fluid deflected from the metering plate will not pass in front of the inlet to the openings, it will not interfere with the fluid passing directly into the inlet of the openings. As a result of the pressure metering plate it is possible to better balance the pressure and fluid flow between the inner and outer nozzle. If more fluid and/or pressure is needed for the outer nozzle, the center opening of the metering plate would be made smaller and this could allow more fluid and pressure for the outer nozzle.

In the fourth embodiment a unit is provided which functions as a combined center vane and meter plate.

Accordingly, an object of our invention is to provide a nozzle body having a spray pattern of a solid nozzle having an initial angle of close to 180°.

Another object of our invention is to coordinate an inner and outer nozzle within a single nozzle body so that the inner nozzle creates a solid cone spray and the outer nozzle creates a hollow cone spray which is adjacent to the inner core spray.

Another object of our invention is to provide a nozzle body for a fire suppression system, roof cooler, etc. in which a minimum number of nozzle bodies are required for a given area due to the wide angle of the solid cone created by the combination of an inner and outer nozzle.

Another object of our invention is to provide a novel disc shaped unit that functions as both a metering plate and a center vane to thereby permit a substantial reduction in the overall length of the nozzle body.

These and other objects of our invention will become more apparent from the detailed description of the drawings.

BRIEF DESCRIPTION OF THE DRAWINGS

FIG. 4 is a cross-section view of the adapter used in the first embodiment of FIG. 2.

FIG. 4*a* is a view of the inlet end of the adapter taken in the direction of the arrows 4*a*—4*a* of FIG. 4.

FIG. 5 is a side view of the center vane that is used in first, second and third embodiments.

FIG. 5*a* is a view of the inlet end of the center vane taken in the direction of the arrows 5*a*—5*a* of FIG. 5.

FIG. 5*b* is a view of the outlet end of the center vane taken in the direction of the arrows 5*b*—5*b* of FIG. 5.

FIG. 5*c* is an angle view of the center vane taken in the direction of the arrows 5*c*—5*c* of FIG. 5.

FIG. 6 is a side view of the pressure metering plate that can be used in the first, second and third embodiments.

FIG. 7 is a cross-sectional view of a second embodiment of the nozzle body and shows a cross-section of the body, the center vane, the adapter, and the pressure metering plate.

FIG. 8 is a cross-sectional view of the body used in the second embodiment of FIG. 7.

FIG. 8*a* is a view of the outlet end of the body taken in the direction of the arrows 8*a*—8*a* of FIG. 8.

FIG. 8*b* is a view of the inlet end of the body taken in the direction of the arrows 8*b*—8*b* of FIG. 8.

FIG. 9 is a cross-sectional view of the adapter used in the second embodiment of FIG. 7.

FIG. 9*a* is an end view of the outlet end of the adapter taken in the direction of arrows 9*a*—9*a* of FIG. 9.

FIG. 9*b* is an end view of the inlet end of the adapter in the direction of the arrows 9*b*—9*b* of FIG. 9.

FIG. 10*a* is an illustration of the fluid spray pattern for the outer nozzle of all embodiments.

FIG. 10*b* is an illustration of the fluid spray pattern of the inner nozzle for all embodiments.

FIG. 11 is a cross-sectional view of a third embodiment of the nozzle body and shows a cross-section of the body, the adapter, the center vane and the pressure metering plate similar to the view of the first and second embodiments of FIGS. 2 and 7.

FIG. 12 is a cross-sectional view of the nozzle body used in the third embodiment of FIG. 11.

FIG. 12*a* is a view of the outlet end of the body taken in the direction of the arrows 12*a*—12*a* of FIG. 12.

FIG. 12*b* is a view of the inlet end of the body taken in the direction of the arrows 12*b*—12*b* of FIG. 12.

FIG. 13 is a cross-sectional view of the adapter used in the third embodiment of FIG. 11.

FIG. 13*a* is an end view of the outlet end of the adapter taken in its direction of the arrows 13*a*—13*a* of FIG. 13.

FIG. 13*b* is an end view of the inlet end of the adapter in the direction of the arrows 13*b*—13*b* of FIG. 13.

FIG. 14 is a side view of a fourth embodiment of our invention and shows a nozzle body having a body and an adapter.

FIG. 15 is a cross-section of the body used in embodiment 4 and shows the combined vane-meter plate in place.

FIG. 15*a* is a view of the inlet of the body and is taken in the direction of the arrows 15*a*—15*a* of FIG. 15.

FIG. 16 is a cross-sectional view of the adapter used in embodiment 4.

FIG. 17 is a side view of the combined metering plate and center vane used in the fourth embodiment of FIGS. 14, 15 and 16.

FIG. 17*a* is a side view of the combined metering plate and center vane of FIG. 17, taken in the direction of the arrows 17*a*—17*a* of FIG. 17 and shows the configuration of the outlet of the vane/plate, although the inlet and outlet are identical configurations.

FIG. 17*b* is an angle view of the combined center vane and metering plate taken in the direction of the arrows 17*b*—17*b* of FIG. 17.

DETAILED DESCRIPTION OF THE INVENTION

The present invention of a 180° nozzle body 100, having an inner nozzle and outer nozzle, can be achieved by the first embodiment shown in FIGS. 1, 2, 3, 4 or a second embodiment shown in FIGS. 7, 8, 9 or a third embodiment shown in FIGS. 11 to 13 or a fourth embodiment shown in FIGS. 11 to 17. Similar components in structure or function in the four embodiments are identified by the same numeral.

Figure 1:
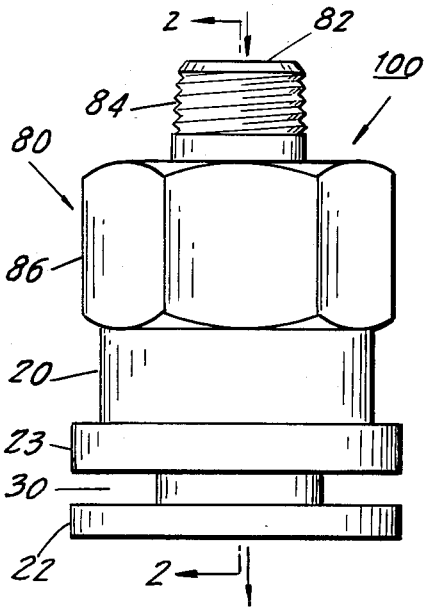
FIG. 1 is a side view of a first embodiment the nozzle body showing the adapter connected to the body.
Figure 2:
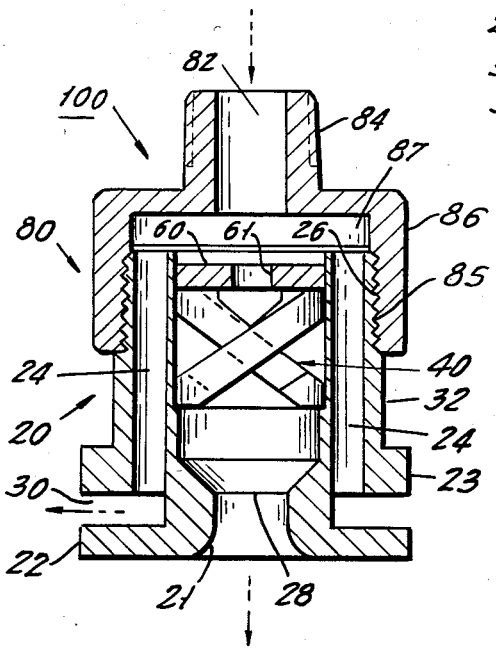
FIG. 2 is a cross-section view of the nozzle body taken in the direction of the arrows 2—2 of FIG. 1 and shows a cross-section of the body, the pressure metering plate, the center vane and the adapter.

In the first embodiment of FIGS. 1 and 2 the second embodiment of FIG. 7, the third embodiment of FIG. 11 and the fourth embodiment of FIG. 14, the complete nozzle body 100 is shown comprised of the adapter 80 connected to the body 20. The body 20, also shown in cross-section in FIGS. 3, 8, 12 and 15, has an inlet end 27 and an outlet end 28. An inner chamber 29 extends from the inlet end and receives the center vane 40, shown in detail in FIG. 5 and the metering plate 60, shown in detail in FIG. 6. The inner chamber 29 may have a lip 25 which serves as a stop for the center vane 40, if it is used. At the outlet end 28 of the inner chamber 29 there is an open area extending directly to the orifice 21. Male threads 26 are located near the inlet end 27 of the body 20 to engage the female threads 85 of the adapter 80 of embodiment 1 and 2 or a pressure fit can be used as set forth for embodiments 3 and 4.

Fluid flows by first entering the inlet end 82 of adapter 80. The outer circumference of the inlet end has male threads 84 or other suitable means for connection to a fluid source. From the inlet end 82 of the adapter 80, the fluid flows to an enlarged space 87 whose inside diameter is greater than that of the inlet end 82. The fluid leaves the enlarged space 87 through two separate paths, an inner nozzle passing through the inner chamber 29 of the nozzle body 20, and an outer nozzle passing through the outer chambers 24. In the inner nozzle, the fluid enters the inlet end 27 of the nozzle body 20, passes through the opening 61 of the metering plate 60 to enter the inner chamber 29, in which it is swirled by the angular configuration center vane 40. After leaving the center vane 40, the fluid exits through the outlet end 28 of the inner chamber 29 and leaves the nozzle body 20 through orifice 21. In the outer nozzle, the fluid enters the outer chambers 24, flows directly to the deflector 22 which deflects the fluid outward toward the space 30 where it leaves the nozzle body 100.

FIG. 1 shows a side view of the first embodiment of the nozzle body 100 of the invention. In this view, adapter 80 is connected to the body 20, and the exterior of the wide portion 86 of the adapter 80 is beveled hexagonally to permit the tightening of this connection by a wrench. As can also be seen from FIG. 1, the first embodiment includes plate 23 parallel to deflector 22 and separated from it by the deflection space 30.

The cross-section view of FIG. 2, shown in FIG. 2, also shows the adapter 80 connected to the body 20, and further shows the center vane 40 and metering plate 60 inside the body 20. Male threads 26 on the outside of body 20 are screwed into female threads 85 on the inside of adapter 80 to make a firm connection. The female threads 85, however, do not extend the entire length of the wide section of the adapter 80, but rather extend only part of the length, so that when the body 20 is completely turned into the adapter 80, a spread space 87 remains between the inlet end 27 of the body and the narrow section at the inlet end 82 of the adapter. FIG. 2 also illustrates the arrangement of the center vane 40 and the metering plate 60 inside the inner chamber 29 of the body. Because of this arrangement, fluid in the spread space 87 can only enter the inner chamber 29 through the center opening 61 in the metering plate 60. When it does so, it encounters the central part of the center vane 40, whose structure is shown in more detail in FIGS. 5, 5*a*, 5*b* and 5*c*. The body 20, shown in more detail in FIGS. 3, 3*a*, and 3*b*, includes the outer chambers 24 in the first embodiment. Thus, fluid may flow from the spread space 87 through the outer chambers 24 to the deflection space 30, or it may flow through the inner chamber 29 to the outlet end 28 and the orifice 21.

As shown in FIG. 2, the center vane 40 and the metering plate 60 are dimensioned so that the metering plate 60 is slightly recessed from the inlet end 27 of the body 20. This arrangement prevents the radial flow of fluid from spread space 87 across the inlet of the outer chambers 24 which otherwise would interfere with the flow of fluid into the outer chambers 24. This inventive feature facilitates the balancing of pressure between the inner nozzle, i.e. the flow of fluid through the inner chamber 29, and the outer nozzle, i.e. the flow of fluid through the outer chambers 24. A pressure fit holds the metering plate 60, and in turn the center vane 40, in place.

Figure 3B:
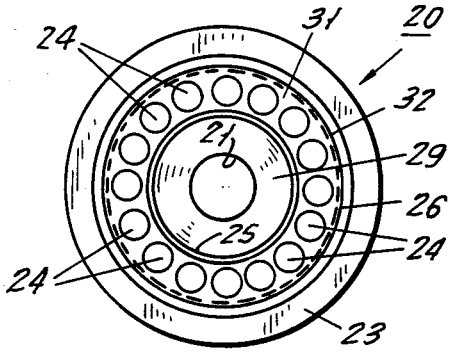
FIG. 3*b* is a view of the inlet end of the body taken in direction of the arrows 3*b*—3*b* of FIG. 3.
Figure 3:
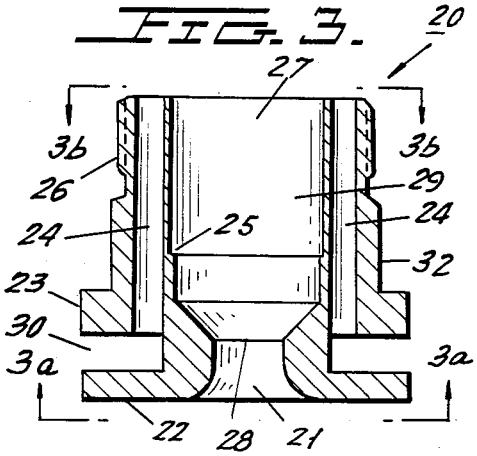
FIG. 3 is a cross-section view of the nozzle body used in the first embodiment of FIG. 2.

FIG. 3 shows in more detail the body 20, and particularly shows the lip 25 around the circumference of the inner chamber 29 upon which the center vane 40 rests. Body 20 may be a cast metal member made, for example, of brass machined to have an axial opening which includes the inner chamber 29 and orifice 21. This opening 29 includes, (a) beginning at the inlet end 27, a section whose internal diameter is substantially equal to the outside diameter of the metering disc 60 and slightly larger than the diameter of the center vane 40; and (b) a shorter region of slightly smaller diameter, to provide the lip 25 on which the center vane 40 can rest; and (c) an evenly tapering region; and, (d) finally, an orifice 21, which is cylindrical where it meets the outlet end 28 but is rounded so that the solid cone spray covers an angle of approximately 125°.

Figure 3A:
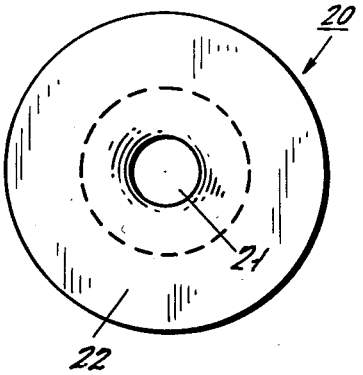
FIG. 3*a* is a view of the outlet end of the body taken in the direction of the arrows 3*a*—3*a* of FIG. 3.

The body 20 is also machined in the first embodiment to include outer chambers 24, which are parallel to the axis of opening 29 but are located immediately surrounding its perimeter. The plurality of outer chamber 24 are separated from each other by the web section 31 (FIG. 3*b*) and are closed at their outer edge by ring section 32. FIG. 3*b* shows in more detail how the outer chambers 24 form a ring which is concentric with the center of the axial opening 29. In the embodiment shown, the outer chambers 24 are cylindrical holes, arranged in a ring around the axial opening 29 and outside of which are the male threads 26. The inlet of the outer chambers 24 are adjacent the inlet end 27 of the body 20 and terminate in the deflection space 30. As shown in FIGS. 2, 3 and 3*a*, the outlet end of the body 20 is orifice 21 and a portion 22 of the body 20 surrounding orifice 21 is a flat annular ring-shaped deflector plate 22 in a plane perpendicular to the axis of the nozzle body 100. Deflection space 30 separates deflector 22 from another annular ring 33 of equal diameter. FIGS. 3*a* and 3*b* together show the axial symmetry of the body 20.

FIG. 4 shows a cross-section of the adapter 80, which is also axially symmetrical and which may be a cast metal member, such as brass, appropriately machined. In the first embodiment, the inlet end 82 of the adapter 80 has a smaller diameter, both inside and outside, than the outlet end 83. The inlet end has female threads 84 or other appropriate structure to permit connection to a fluid source. The axial opening through the inlet end is cylindrical, and terminates at the beginning of a larger cylindrical opening, the spread space 87. As described above, the spread space 87 permits the movement of fluid into the outer chambers 24 in the body 20, so that the diameter of the spread space 87 is at least as great as the outer diameter of the ring of outer chambers 24. In practice, it is most convenient to make the spread space 87 by first machining an axial cylindrical opening from the outlet end 83 of the adapter 80 and then machining female threads 85 from the outlet end 83 up to the edge of the spread space 87. Therefore, the inside diameter of the spread space 87 will be slightly smaller than the outside diameter of the male threads 26 on the body 20.

FIG. 4*a* shows the axial symmetry of the adapter, and also shows the hexagonal bevel 86 which permits tightening of the connection to the fluid source or to the body 20.

FIG. 5 shows the center vane 40 used in the first three embodiments of the invention. The center vane 40 may also be a cast metal member such as brass machined appropriately, but it is not axially symmetrical. Instead, its shape is like two semicircular discs attached at their center but with their ends at an angle to each other. In FIG. 5, the near semicircular disc has an upper side 42 and a lower side 44, while the far semicircular disc has an upper side 43 and a lower side 45. As can be seen from FIG. 5, however, the two semicircular discs may be machined from a unitary solid metal casting, and, in the embodiment shown, a "V" notch 46 is machined in the plane in which they meet. FIG. 5*a* shows more clearly how the two semicircular discs meet and are connected in the plane in which notch 46 is machined.

The center vane 40 is placed on the lip 25 in the body 20, and metering plate 60, in turn, is positioned immediately above the center vane 40. Also, the center vane 40 fits snugly against the wall of the inner chamber 29. Therefore, the outer edge of the center vane 40 is circular when viewed from above as in FIG. 5*a* or from below as in FIG. 5*b*. At the point of contact with the lip 25 and the metering disc 60 the center vane 40 is beveled to present a flat surface, as shown in FIG. 5. FIGS. 5*a* and 5*b* also show grooves 41 and 41′ which are machined in the respective semicircular discs to permit additional flow of fluid through the center vane 40. As can be seen more clearly from FIG. 5*c*, groove 41 is machined to have three sides which meet at right angles and are of approximately equal length. One side lies in the same plane as the lower side 45 of the other semicircular disc, and the side which joins it is parallel to the plane in which the two semicircular discs meet. Therefore, the third side is parallel to the plane of the lower side 45 of the other semicircular disc. FIG. 5*b* shows how, with this arrangement, the two notches 41 and 41′ meet at the point where the lower sides 44 and 45 meet.

FIG. 6 shows the metering plate 60, which may be a solid metal disc such as brass with the same outer diameter as the internal diameter of the inner chamber 29. Center opening 61 is machined perpendicular to the plane of the plate. Just below center opening 61, notch 46 in the center vane 40 begins at its top with short parallel sides. Notch 46 then tapers in a V shape, with the apex of the V being at the intersection of the upper side 42 and 43 of the semicircular discs, and the sides of the V being at a 90° angle from each other, as shown in FIG. 5.

A cross-sectional view of the second embodiment of nozzle body 100 appears in FIG. 7. As discussed above, center vane 40 and metering plate 60 are the same as for the first embodiment discussed above. Also, the metering plate 60 is slightly recessed from the inlet end 27 of the body 20 to facilitate the balancing of pressure between the inner and outer nozzles, as was discussed for the first embodiment above. As can be seen from FIG. 7, however, the body 20, shown in more detail in FIGS. 8, 8*a*, and 8*b*, and the adapter 80, shown in more detail in FIGS. 9, 9*a*, and 9*b* differ from those of the first embodiment.

As shown in FIG. 8, the axial openings of the body 20 of the second embodiment also comprises five sections. Beginning from the inlet end 27 of the body 20, the first is a cylindrical section; the second is a cylindrical section 29 of smaller inner diameter than the first cylindrical section adjacent the inlet and includes inner chamber 29; the third is also a cylindrical section, whose inner diameter is slightly smaller than that of the second section, thus forming the lip 25 between the second and third cylindrical sections; the fourth is an evenly tapering section whose inner diameter reduces from that of the third cylindrical section to that of the orifice 21, and whose tapering sides, if extended, would meet at a 90° angle; and the fifth is the orifice 21, which is cylindrical where it meets the tapering section at the outlet end 28, but which increases in diameter in a conical manner as it approaches the outer plane of deflector 22.

Similarly, the outer surface of the body 20 is machined to include four sections, the first of which is a cylindrical section of the same axial length as the first section of the axial opening through the body 20; the second of which is a threaded section 26 whose outside diameter is slightly larger than that of the first section, and whose length is approximately half that of the second section of the axial opening; the third section of which is cylindrical with an outside diameter slightly larger than that of the inner chamber 29 of the axial opening, and whose length extends from the end of the threaded section so that part of the orifice 21 whose diameter is increasing in a curved manner; and a fourth section which is an annular ring-shaped deflector plate 22, and which has an outside diameter slightly larger than that of the threaded section 26, and a length approximately the same as that part of the orifice 21 whose diameter is increasing in a conical manner.

FIG. 8*a* shows the relationship between the deflector 22, the orifice 21 and the outlet end 28 of the body 20. As can be seen, the orifice 21 begins at the hollow cylindrical interior and increases until it meets the outer plane of the deflector 22.

FIG. 8*b* shows six arcuate sections which are machined through the threaded sections 26 of the body 20, and which form the inner sides of the outer chambers 24. These sections divided by webs 31 must be deep enough to make openings in the first cylindrical section of the body 20, so that fluids may enter the outer chambers 24 from the spread space 87. As can be seen from FIGS. 8*a* and 8*b*, the body 20 is axially symmetrical.

In the second embodiment the outer chambers 24 are formed by the webs 31 of the body 20 and the cylindrical ring portion 32 of the adapter 80. In the arrangement shown the threads 85 of adapter 80 are fastened to the threads 26 on webs 31. The adapter 80 for the second embodiment appears in FIG. 9 in cross-section. Like the body 20, it is axially symmetrical, and can be machined from a cast metal member. Like the adapter 20 for the first embodiment shown in FIG. 4, it includes an inlet end 82, of relatively small inside diameter, with male threads 84 on its outer circumference, and an outlet end 83 of relatively large diameter. Unlike the adapter of FIG. 4, however, the adapter 80 of FIG. 9 includes a cylindrical section 33 between the female threads 85 and the outlet end 83, thereby creating the chamber 88. The chamber 88 has an inside diameter slightly larger than that of the female threads 85, and therefore is spaced apart from the third section of the outer wall of the body 20, described above, to form the outer hollow cylindrical ring chamber. Therefore, the length of the chamber wall 33 is sufficiently shorter than the length of the third section of the outer wall of the body 20 so that when the adapter 80 and the body 20 are connected, a space remains between the outlet end 83 of the chamber 88 and the upper surface of the deflector 22, forming the deflection space 30.

FIG. 9*a* shows the relative diameters of the chamber 88 formed by chamber wall 33, the female threads 85, and the inlet end 82 of the adapter 80. As shown in FIGS. 9*a* and 9*b*, the outer wall of the adapter 80 has hexagonal bevels 86 to permit the tightening of a connection with a fluid source or with the body 20.

The operation of the invention, which is similar for the four embodiments, is depicted in FIGS. 10*a* and 10*b*. FIG. 10*a* shows the inner nozzle, in which the fluid passes through the inlet end 82 of the adapter 80, through the spread space 87 and the center opening 61 in the metering plate 60, is swirled by the center vane 40, and leaves the body 20 through the outlet end 28 and the orifice 21, generating a solid conical stream of fluid. FIG. 10*b* shows the outer nozzle, in which the fluid enters the inlet end 82 of the adapter 80, goes through the spread space 87 into the outer chambers 24, is deflected by the deflector 22 into the deflection space 30, from which it exits to form a hollow conical pattern. The combination of the solid conical stream from the inner nozzle and the hollow conical stream from the outer nozzle is a solid conical stream which covers nearly 180°.

The exact measurement of the parts of the invention which will produce the desired solid conical stream will depend on the nature of the fluid, the pressure on the fluid, and the overall size of the nozzle body. Applicants have found that with an overall nozzle body length of three inches, the following dimensions for the first embodiment will produce the desired solid conical stream if the fluid is water. The body 20 is two inches or less in length, and the outer diameter of the deflector 22 is 2.125 inches; the deflector is 3/16 inch thick and the deflection space 30 is 0.210 inch wide. The outer chambers in the first embodiment are 16 cylindrical holes machined through the body 20 in a ring, and each hole has an inner diameter greater than 0.203 inch. The inner diameter of the inner chamber 29 is approximately 1 inch, and the length of the inner chamber 29 from the inlet end 27 to the notch 25 is 1 inch. The center vane 40 is approximately 1 inch in diameter to fit inside the inner chamber 29, and it is 0.56 inch in length. The groove 41 has parallel sides which are 0.375 inch apart adjacent to the metering plate 60, and has a V section whose sides meet at a 90° angle. The metering plate 60 is approximately 1 inch in diameter, 0.125 inch thick, and the center opening 61 is 0.25 inch in diameter. The adapter 80 is about 1.7 inches in length, has an outer diameter at the inlet end of 0.5 inch, and has an inner diameter at the outlet end 83 of 1.5 inches.

With the above dimensions, the operation of the invention results in the spray diameters shown in Table 1 at a distance of 3 inches from the outer plane of the deflector 22.

TABLE 1

| | | | | | |
|---|---|---|---|---|---|
| Pipe Connection (in inches) | 0.5 | 0.5 | 0.5 | 0.5 | 0.5 |
| Center Vane Diameter (inches) | 1 | 1 | 1 | 1 | 1 |
| Pressure (PSI) | 10 | 20 | 30 | 40 | 50 |
| Flow Rate (GPM) | 17 | 25 | 31 | 35 | 39 |
| Exit Spray Angle (Degrees) | 180 | 180 | 180 | 180 | 180 |
| Spray Diameter (Feet) | 8 | 11 | 14.3 | 15 | 17 |

In the third embodiment of FIGS. 11 to 13, is constructed so that the outer chambers 24 consist of three openings, as seen in FIG. 12*b*, rather than sixteen openings as seen in FIG. 3*b* or six openings as seen in FIG. 8*b*. The outer chambers 24 are formed by the dividers web 31 and outer ring 32 of the body 20. It is noted that the deflector plate 22, as seen in FIGS. 11 and 12 has a curved surface or lip 34 which aids in throwing the liquid out to a wider diameter and thereby aids in creating an outer cap closed to 180°.

As seen in FIG. 13 the adapter 80 has a lip 35 which forms a hollow cylinder at the outlet end of the adapter. This lip 35 can be flared or rolled over, after assembly with the body 20, as seen in FIG. 11, and thus prevent the body 20 from being removed from the adapter 80.

In the fourth embodiment of FIGS. 14 to 17 it will be noted that the outer chambers 24 are formed by the four webs 31 of the body 20 and the hollow cylindrical ring 32 of the adapter 80.

It will be noted that in the arrangement shown on the web or spoke 31 does not have any external threads. However, the external diameter of the webs or spokes 31 is substantially the same as the internal diameter of the outlet chamber of the adapter 80. Hence there is a pressure fit between the adapter 80 and body 20. It is noted that this arrangement could also be used in the second embodiment to thereby eliminate the need for threads 26 and 85 as seen in FIGS. 8 and 9.

This particular arrangement illustrates four outer chambers 24 for the fourth embodiment as seen in FIG. 15*a* as compared to sixteen for the first embodiment as seen in FIG. 3*b*, six outer chambers for the second embodiment of FIG. 8*b* and three outer chambers for the third embodiment of FIG. 12*b*.

The fourth embodiment utilizes a combined metering plate 60 and center vane 40 as best seen in FIGS. 17, 17*a* and 17*b* and identified by the numerals 40, 60. The combined metering plate/center vane is a disc in which a slot 61 is cut in one half of the disc and slot 62 in the other half in which each slot is cut on an angle on each side of the axis of the disc. The slot thickness is substantially the thickness of the disc so that there is a section at the top and bottom half of the disc 40, 60 which passes directly through the disc in a direction parallel to the axis. However, the fluid which impinges on the other portions of the disc, and particularly the fluid that impinges on the area where the slots start, will be swirled. Hence the portion of fluid which passes through the disc without changing its direction will form the central portion of the internal solid spray cone and the portion that is wirled will form the outer portion of the inner solid cone spray as seen in FIG. 10*a*. The novel combined metering disc and center vane 40, 60 enable the length of the nozzle body 100 to be substantially reduced. It is noted that the combined metering plate/center vane 40, 60 could also be used with the embodiments 1, 2 or 3 if it becomes desirable to reduce the length of these units.

Although the present invention has been described in connection with two preferred embodiments thereof, many variations and modifications will now become apparent to those skilled in the art. It is preferred, therefore, that the present invention be limited not by the specific disclosure herein, but only by the appended claims.

What is claimed is:

1. A nozzle body having an inner and outer nozzle, said inner nozzle having an orifice to discharge fluid in a solid cone spray, said outer nozzle having a deflector plate to discharge fluid in a hollow cone spray that is adjacent to the solid cone spray; the inner nozzle has a center vane in axial alignment with said orifice; said outer nozzle has a plurality of openings that are located around the outer circumference of said inner nozzle and parallel to the axis of said inner nozzle and parallel to each other; said deflector plate is in a plane substantially perpendicular to the common axis of the inner and outer nozzle; said plurality of openings extend in a direction and are positioned substantially perpendicular to said deflection plate; said nozzle body having an inlet end and an outlet end; said orifice and said deflection plate located at said outlet end; said outer nozzle being constructed to permit fluid entering said plurality of openings to be discharged against said deflector plate, said inner nozzle being constructed to permit fluid entering said center vane to be discharged from said orifice; said center vane is located in an inner chamber with said plurality of openings located around the outer perimeter of said inner chamber.

2. The nozzle body of claim 1 in which a metering plate is located in said inner chamber flush with said center vane and spaced from the inlet end of said inner chamber; said metering plate having an opening to permit some fluid to pass to said center vane and said orifice.

3. The nozzle body of claim 2 in which said metering plate and the inlet end of said inner chamber create a small chamber and can deflect some fluid impinging on said plate to the periphery of the inlet end of said small chamber.

4. The nozzle body of claim 1 in which the combination of the inner and outer nozzles has substantially the same rate of fluid discharge as the rate of fluid inlet.

5. The nozzle body of claim 4 in which the inlet end is comprised of an adapter and the outlet end is comprised of a body wherein the adapter is removably connected to the body.

6. The nozzle body of claim 5 in which said adapter has an inlet end to connect to a source of fluid and can be connected to said body.

7. The nozzle body of claim 6 in which said adapter is constructed and dimensioned to permit fluid passing therethrough to pass to the inlet of said plurality of openings as well as to the said center vane.

8. The nozzle body of claim 7 in which said inner and outer nozzle has a spray pattern that results in a solid cone with the inner nozzle providing fluid for the inner portion of the cone and the outer nozzle providing fluid for the outer part of the cone.

9. The nozzle body of claim 8 in which said center vane is positioned axially with respect to said inner nozzle within said inner chamber and is at least partially surrounded by said plurality of openings.

10. The nozzle body of claim 9 in which the outside diameter of said center vane is the same as the inside diameter of said inner chamber.

11. The nozzle body of claim 8 in which the outside diameter of said center vane is the same as the inside diameter of said inner chamber.

12. The nozzle body of claim 11 in which said plurality of openings are circumferentially positioned at a diameter which is greater than the inside diameter of said inner chamber.

13. The nozzle body of claim 11 in which said center vane is held in position within said inner chamber by a pressure fit.

14. The nozzle body of claim 13 in which said adapter has a female section which can be engaged with male section on said body.

15. The nozzle body of claim 14 in which a metering plate abuts against the outer circumference of said center vane.

16. The nozzle body of claim 15 in which said center vane has an opening adjacent said center opening of said metering plate to permit some fluid to pass through said center opening of said metering plate directly to said center vane.

17. The nozzle body of claim 16 in which there is 180° spray in a plane perpendicular to the axis of the body and located at the deflection plate.

18. A nozzle body comprising a body and an adapter; said adapter having a first portion to connect to a pipe from which fluid will flow through said adapter to said body and a second portion connected to said body; said nozzle body comprising an inner and outer nozzle;

said body containing an inner cylindrical chamber at a first end and an orifice at a second end with said orifice being in axial alignment with said inner cylindrical chamber; said first and second portions of said adapter being in axial alignment with said inner chamber and said orifice of said body; said second portion of said adapter being removably connected to said body at the end of said body containing said inner chamber wherein said body and said adapter are axially aligned with each other;

a center vane positioned within said inner chamber of said body and being positioned in axial alignment with said orifice; said inner nozzle discharging fluid through said orifice in a solid cone;

said nozzle body having a plurality of openings positioned around the outer periphery of said body and positioned parallel to the axis of said body; said body containing a deflection plate at its second end positioned concentrically around said orifice; the internal diameter of said second portion of said adapter being greater than the outside diameter of said inner chamber so that fluid in said second portion can pass through both said inner chamber and said plurality of openings; said plurality of openings having a discharge end spaced from deflector plate to permit fluid discharged from said plurality of openings to impinge upon said deflector plate and create a hollow cone spray adjacent the solid cone spray discharged from said orifice.

19. The nozzle body of claim 18 in which a metering plate is located in said inner chamber adjacent to said center vane, said metering plate having an opening to permit fluid to pass from said adapter through said opening to said center vane.

20. The nozzle body of claim 19 in which said metering plate is located inside said inner chamber and removed from the inlet end of said inner chamber to thereby create a small chamber in which fluid impinges directly on said metering plate will be deflected to the inside wall of said inner chamber.

21. The nozzle body of claim 18 in which said body has a male section located on the outside of said plurality of openings for attaching to said adapter and in which said section is positioned concentric to said plurality of openings.

22. The nozzle body of claim 21 in which a plate is concentrically positioned around the outer circumference of said body adjacent the discharge end of said plurality of cylindrical opening and parallel to said deflector plate whereby fluid discharged from said plurality of openings passes between said deflector plate and said plate.

23. The nozzle body of claim 15 in which said adapter has an outlet portion for said outer nozzle, said outlet portion being spaced from said body and forming with said body a cylindrical space adjacent the outlet end of said plurality of openings wherein fluid discharged from said plurality of openings passes through said space and then to said deflection plate.

24. The nozzle body of claim 15 in which said center vane is in the form of a disc; said center vane having a slot in both its upper and lower half wherein slot is at an angle to the axis of the center vane; said slots being a width substantially equal to the thickness of the disc so that a portion of the top and bottom of the disc has an opening from front to back that is parallel to the axis of the disc.

* * * * *